US005743521A

United States Patent [19]

Munakata et al.

[11] Patent Number: 5,743,521

[45] Date of Patent: Apr. 28, 1998

[54] SHEET THICKNESS DETECTING DEVICE FOR DETECTING THICKNESS FROM THE CHANGE IN DISTANCE BETWEEN ROLLERS

[75] Inventors: Atsushi Munakata, Yokohama; Toshiro Tomono, Kawasaki, both of Japan

[73] Assignee: Canon Kabushiki Kaisha, Tokyo, Japan

[21] Appl. No.: 798,932

[22] Filed: Feb. 11, 1997

Related U.S. Application Data

[63] Continuation of Ser. No. 324,490, Oct. 18, 1994, abandoned.

[30] Foreign Application Priority Data

Oct. 22, 1993 [JP] Japan ..... 5-264915
Nov. 10, 1993 [JP] Japan ..... 5-305947

[51] Int. Cl.[6] ..... B65H 7/12

[52] U.S. Cl. ..... 271/263; 271/265.04

[58] Field of Search ..... 271/259, 262, 271/263, 242, 265.02, 265.04; 364/563; 209/603, 604; 324/229, 230

[56] References Cited

U.S. PATENT DOCUMENTS

| | | | |
|---|---|---|---|
| 4,491,929 | 1/1985 | Ikoma et al. . | |
| 4,700,368 | 10/1987 | Munn et al. | 271/263 X |
| 4,894,783 | 1/1990 | Milne | 271/263 X |
| 4,982,947 | 1/1991 | Milne | 271/263 |
| 5,029,837 | 7/1991 | Uchiyama | 271/263 X |
| 5,110,105 | 5/1992 | Nicoll et al. | 271/263 X |

FOREIGN PATENT DOCUMENTS

| | | | |
|---|---|---|---|
| 080309 | 6/1983 | European Pat. Off. . | |
| 4125450 | 2/1993 | Germany . | |
| 57-004062 | 1/1982 | Japan . | |
| 61244 | 3/1991 | Japan | 271/262 |
| 39236 | 2/1992 | Japan | 271/242 |
| 294511 | 11/1993 | Japan | 271/263 |
| 294512 | 11/1993 | Japan | 271/263 |
| 2218524 | 11/1989 | United Kingdom | 271/263 |

*Primary Examiner*—Boris Milef
*Attorney, Agent, or Firm*—Fitzpatrick, Cella, Harper & Scinto

[57] ABSTRACT

A sheet thickness detecting device for detecting the thickness of a recording member precisely irrespective of accuracy of parts is disclosed. A state that a roller 1 of a pair of rollers 1, 2 is positioned at a predetermined angle of rotation, is detected by a flag 11 fixed to the axle of the roller 1 and a photosensor 12 for roller rotation angle detection. A signal from a photosensor 8 for roller pair axes distance detection is processed in accordance with a signal from the photosensor 12 to detect the thickness of a recording member P. In this device, the thickness of the recording member P is detected when the rollers 1, 2 are positioned at the predetermined angle of rotation. Thus, it can be detected accurately without being affected by eccentricities of the rollers 1, 2.

15 Claims, 15 Drawing Sheets

SHEET THICKNESS DETECTING DEVICE FOR DETECTING THICKNESS FROM THE CHANGE IN DISTANCE BETWEEN ROLLERS

This application is a continuation-in-part, of application Ser. No. 08/324,490 filed Oct. 18, 1994, and now abandoned.

BACKGROUND OF THE INVENTION

1. Field of the Invention

The present invention relates to a sheet thickness detecting device provided in an image forming apparatus such as a copying machine, facsimile, etc. for detecting the thickness of a recording member, and more particularly to a sheet thickness detecting device for detecting the thickness of a recording member based on the change in distance between axes of two rollers for feeding the recording member.

2. Related Background Art

Recently, image forming techniques in electrophotography and ink jet methods have progressed. Also, regarding image forming apparatuses, apparatuses capable of forming images with full color are starting to be widely used. On the other hand, regarding recording members, various materials for forming various types of images have been developed. Particularly, in color image forming apparatuses, it is required to record images on recording members having various thicknesses since images with high appearance quality can be obtained if much thicker papers are utilized.

However, in order to maintain image quality correspondingly to recording members having various thicknesses, it is necessary to optimize various conditions in forming images.

For example, in a fixing process of the electrophotography method for heating, pressurizing, melting and fixing toner transferred on a recording member, as a quantity of heat required for a thin recording member is different from that required for a thick recording member, it is necessary to carry out temperature control based on the thicknesses of recording members.

Also, even though recording members are formed of the same material, if their thicknesses are different, their volume resistivities are different. Therefore, in order to obtain images with uniform quality, in a transfer process, it is necessary to vary current for driving a transfer charger based on the thicknesses of recording members.

On the other hand, in the ink jet recording method, the distance between a recording head and a recording member has great influence on image quality. In order to maintain constantly uniform image quality, it is necessary to keep the distance between the recording head and a surface of the recording member constant in spite of the thickness of the recording member.

Also, since a serial scanning method is used for forming images, it is necessary to feed a recording member intermittently by an amount equivalent to a width of recording with accuracy. However, when the rotation angle of a feed roller is constant, the feeding amount is changed based on the thickness of the recording member.

In view of the above, image forming apparatuses equipped with means for detecting the thicknesses of recording members have been developed recently.

FIG. 10 shows a conventional detecting device in an image forming apparatus for detecting the thickness of a recording member.

An actuator 72 urged by a spring 71 is disposed in a feeding passage 70 for a recording member P. In this case, the thickness of the recording member P is detected by actuating the actuator 72 in accordance with the feeding of the recording member P and then detecting the displacement of the actuator 72 by means of a photosensor 73. However, according to this structure, it is difficult to detect a wide range of thicknesses of recording members.

For example, when the thickness of the recording member P is small, it is necessary to minimize the urging force of the actuator 72 due to the spring 71. However, under that condition, it is difficult to detect the recording paper P having a comparatively larger thickness and being in a curled state.

For improving this problem, there is a method for detecting the thickness of a recording member by detecting the change in distance between the axes of a pair of rollers for nipping and feeding the recording member.

FIG. 11 schematically shows a conventional sheet thickness detecting device for detecting the thickness of a recording member by the use of a pair of rollers. The recording member P is pinched and fed by a pair of metallic rollers 81*a*, 81*b*. The thickness of the recording member P is detected by means of a photosensor 82 by detecting the displacement of the upper roller 81*a* between before and after the pinching of the recording member P.

FIG. 12 is a graph showing output waveforms of the photosensor 82 when an ordinary sheet and a comparatively thicker sheet are fed between the rollers 81*a* and 81*b*. In FIG. 12, S1 is the output waveform of the ordinary sheet while S2 is the output waveform of the thicker sheet. If a threshold is set to $S_0$, the discrimination between the ordinary sheet and the thicker sheet becomes possible. According to this sheet thickness detecting method, resistance applied to the recording member is small as compared to the above method using the actuator 72, and the occurrence of the detection error is less as compared to a method in which a recording member is detected with no contact since the recording member will not float.

However, in the sheet thickness detecting device using the two rollers, as shown in FIG. 13, since the eccentricities of the rollers 81*a*, 81*b* cause an error e at the time of measurement. Therefore, it is necessary to work the rollers 81*a*, 81*b* with high precision. For example, if the center of each of the rollers 81*a*, 81*b* is off-centered by 20 μm, the distance between the axes of the rollers 81*a*, 81*b* is changed maximumly by ±40 μm depending on their phases. For this reason, it becomes difficult to discriminate even the recording member having a thickness of 100 μm from that of 200 μm. Further, the working of rollers 81*a*, 81*b* with high precision leads to rising of manufacturing cost.

SUMMARY OF THE INVENTION

It is an object of the present invention to provide a sheet thickness detecting device capable of detecting the thickness of a recording member with high precision irrespective of accuracy of parts.

A sheet thickness detecting device according to a first invention includes means (11, 12) for detecting a state that one of a pair of rollers (1, 2) is positioned at a predetermined angle of rotation, and detects the thickness of a recording member (P) in accordance with a signal from the detecting means.

A sheet thickness detecting device according to a second invention includes calculating means (9*b*) for averaging the output value of a point on an output waveform output from roller pair axes distance detecting means (8) and the output value of a point on the output waveform advanced half a roller rotation cycle away from the initial point, and detects the thickness of a recording member (P) based on the averaged value.

In the sheet thickness detecting device according to the first invention, the thickness of the recording member (P) is detected when the rollers (1, 2) are positioned at the predetermined angle of rotation. Therefore, its detection can be performed with high precision without being affected by eccentricities of the rollers (1, 2).

Also, in the sheet thickness detecting device according to the second invention, the influence of the eccentricities of the rollers (21*a*, 21*b*) can be eliminated by averaging the output values of the two points on the output waveform spaced half a roller rotation cycle away from each other by the use of the calculating means (9*b*). Therefore, the difference between the output value obtained before the recording member (p) passes between the rollers and the output value obtained while the recording member (p) is passing between the rollers, is calculated by the calculating means (9*b*), whereby the thickness of the recording member can be obtained with high precision without being affected by the eccentricities of the rollers.

It is to be noted that the above reference numerals in parentheses are for referring to the drawings and will not limit the structure of the present inventions.

DETAILED DESCRIPTION OF THE PREFERRED EMBODIMENTS

Embodiments of the present invention will be described with reference to the accompanying drawings.

[Embodiment of the First Invention]

Figure 1:
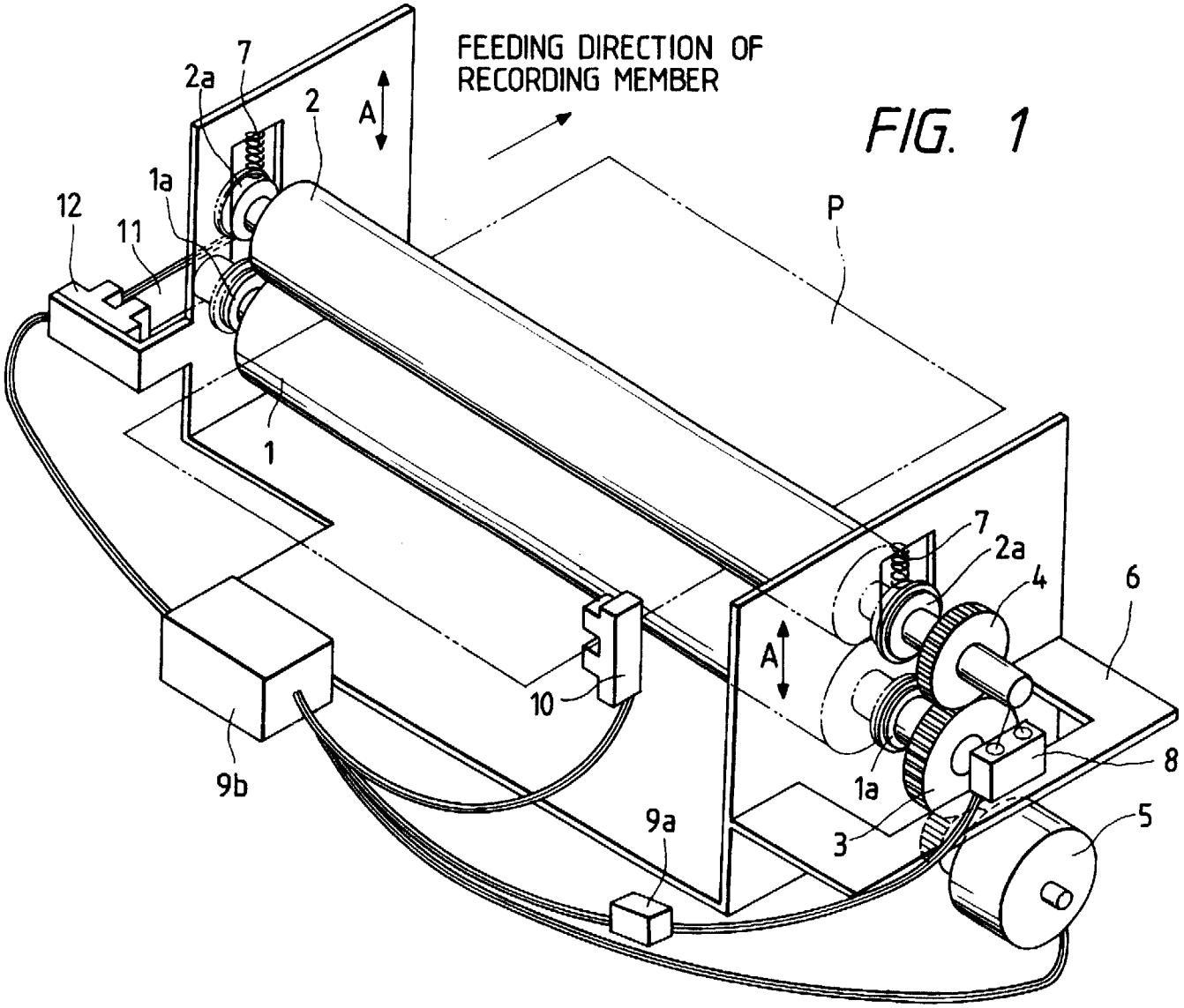
FIG. 1 is a perspective view showing the structure of a sheet thickness detecting device according to an embodiment of the first invention.

FIG. 1 is a perspective view showing a sheet thickness detecting device according to the first invention.

In FIG. 1, a sheet-like recording member P is pinched and fed by a feed roller 1 and a pressure roller 2. Gears 3, 4 are mounted on shaft end portions of the rollers 1, 2 so as to rotate together with the rollers 1, 2, respectively. Since the respective pitch diameters of the gears 3, 4 are substantially equivalent to the respective outer diameters of the rollers 1, 2, the gears 3, 4 are meshed with each other, and the phase relationship between the rollers 1 and 2 in the direction of rotation is always constant. A driving source 5 is connected to the gear 3 so as to drive the rollers 1, 2.

The respective rollers 1, 2 are supported via bearings 1*a*, 2*a* by a supporting member 6. In particular, the pressure roller 2 is supported so as to be movable in the vertical direction (direction A indicated by an arrow) and both end portions of the pressure roller 2 are urged by springs 7 toward the feed roller 1. The rollers 1, 2 are formed of metal so as to prevent their deformation. Also, the surface of the feed roller 1 is subjected to the blast treatment so as to prevent the slipping of the recording member P at the time of its feeding.

A reflection type photosensor 8 for detecting a distance between axes of the pair of rollers 1 and 2 is mounted on the supporting member 6. The photosensor 8 has a light emitting element for emitting infrared light to a shaft end portion of the pressure roller 2 and a light receiving element for receiving the light reflected by that portion to output a voltage corresponding to an amount of the reflected light. At this time, the output voltage inversely proportional to the distance between the rollers 1 and 2 is obtained by the photosensor 8. The output voltage is converted into a digital signal by an A/D converter 9*a* and sent to a CPU (Central Processing Unit) 9*b*.

As the sensor for roller pair axes distance detection, a PSD (Position Sensitive Detector) or a gap sensor may be utilized.

A transmission type photosensor 10 is disposed on the upstream side of the rollers 1, 2 in the feeding direction of the recording member P. The leading end of the recording member P is detected by the photosensor 10 when it interrupts the light path of the photosensor.

A flag 11 is mounted on a shaft end portion of the roller 1 so as to rotate together with the roller 1. Also, a transmission type photosensor 12 for detecting rotation angle of the roller is mounted on the supporting member 6. The flag 11 interrupts light from the photosensor 12 only when the feed roller 1 is at a predetermined angle of rotation, whereby the state that the feed roller 1 is at the predetermined angle of rotation is detected by the sensor 12.

Figure 2:
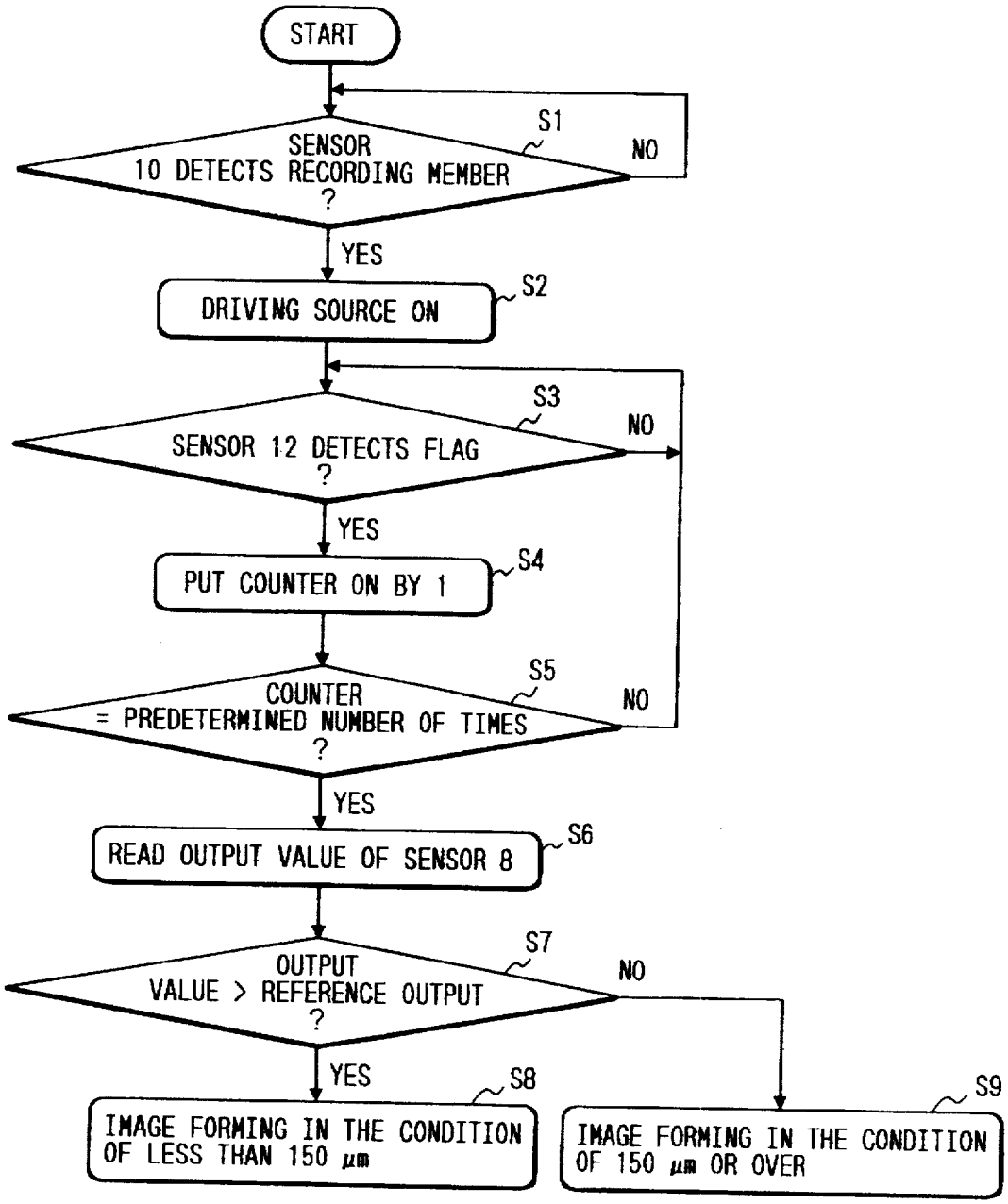
FIG. 2 is a flowchart for explaining the operation of the sheet thickness detecting device of the embodiment of the first invention.

Next, the operation of detecting the thickness of the recording member by means of the device of this embodiment will be described with reference to FIG. 1 and the flowchart of FIG. 2.

In this embodiment, it is necessary to switch the image forming process between the recording member with the thickness of 150 μm or more and the recording member with the thickness of less than 150 μm.

In the device of this embodiment, output values of the photosensor 8 for roller pair axes distance detection are stored in a memory (not shown), one of the output values being obtained when the flag 11 of the feed roller 1 is located at the rotation angle where the light from the photosensor 12 for roller rotation angle detection is interrupted and the recording member P is not pinched by the rollers 1, 2, and the other of the output values being obtained when the recording member P of 150 μm is pinched by the rollers 1, 2 at the same angle of rotation.

When the leading end of the recording member P fed from the upstream interrupts the light from the photosensor 10, the output from the photosensor 10 is changed to detect the reaching of the recording member P (S1). At the same time, CPU 9 drives a driving source 5 (S2), whereby the rollers 1, 2 start rotating at a peripheral speed equal to the feeding speed of the recording member P. When the leading end of the recording member P reaches the rollers 1, 2, it is pinched and fed by the rollers 1, 2. The distance between the axes of the rollers 1 and 2 at the moment, when the recording member P is pinched by the rollers 1, 2, increases by an amount corresponding to the thickness of the recording member P, but changes momently in accordance with rotation of the rollers 1, 2 owing to the influence of the eccentricities of the rollers 1, 2.

From the moment when the recording member P has reached the recording member detection sensor 10 located in the upstream direction, the rollers 1, 2 start rotating. Thereafter, each time the rotation angle detection sensor 12 detects the flag 11, CPU 9 counts the number of times of the detection (S3, S4). When the number of times reaches a predetermined number of times stored in a memory (S5), the output value of the roller axes distance detection sensor 8 is read and stored in the memory (S6). Then this stored output value is compared with the output value (reference output) of the sensor 8 obtained and stored beforehand when the recording member with the thickness of 150 μm is pinched by the rollers 1, 2 (S7). Thereby, the thickness of the recording member P is judged and image formation is carried out under each condition (S8, S9).

In the above sheet thickness detecting device, as the thickness of the recording member P is detected when the rollers 1, 2 are located at the predetermined angle of rotation, it is possible to detect it accurately without being affected by the eccentricities of the rollers 1, 2.

<Example 1 for control>

Figure 3:
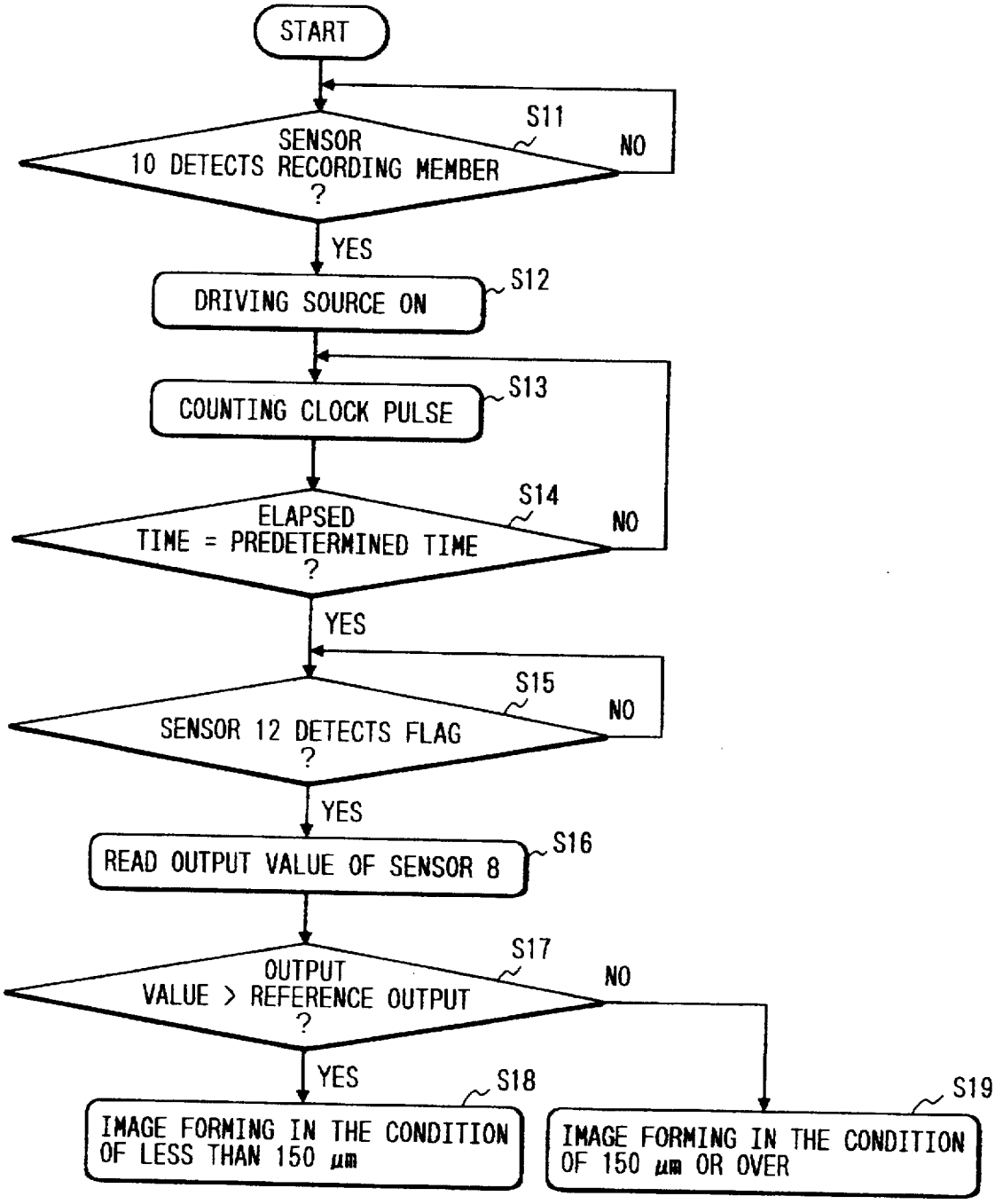
FIG. 3 is a flowchart for explaining a first control example in the embodiment of the first invention.

In the sheet thickness detecting device of the above embodiment, the timing of detecting the thickness of the recording member can be determined in the following manner. The operation of this case is shown in a flowchart of FIG. 3.

From the moment when the recording member P reaches the recording member detecting sensor 10 in the upstream, the rollers 1, 2 start rotating and the elapsed time from this moment is measured by a reference clock of CPU 9 (S11 to S13). After the elapse of a predetermined period of time set beforehand based on the distance between the sensor 10 and the rollers 1, 2, and first when the flag 11 mounted on the roller 1 interrupts the light from the roller rotation angle detecting sensor 12 mounted on the supporting member 6, the output value of the roller axes distance detecting sensor 8 is stored in the memory (S14 to S16). This stored output value is compared with the output value (reference output) of the sensor 8 obtained and stored beforehand when the recording member with the thickness of 150 μm is pinched by the rollers 1, 2. Thereby, the thickness of the recording member P is judged and image formation is carried out under a preferable condition (S17 to S19).

<Example 2 for control>

Figure 4:
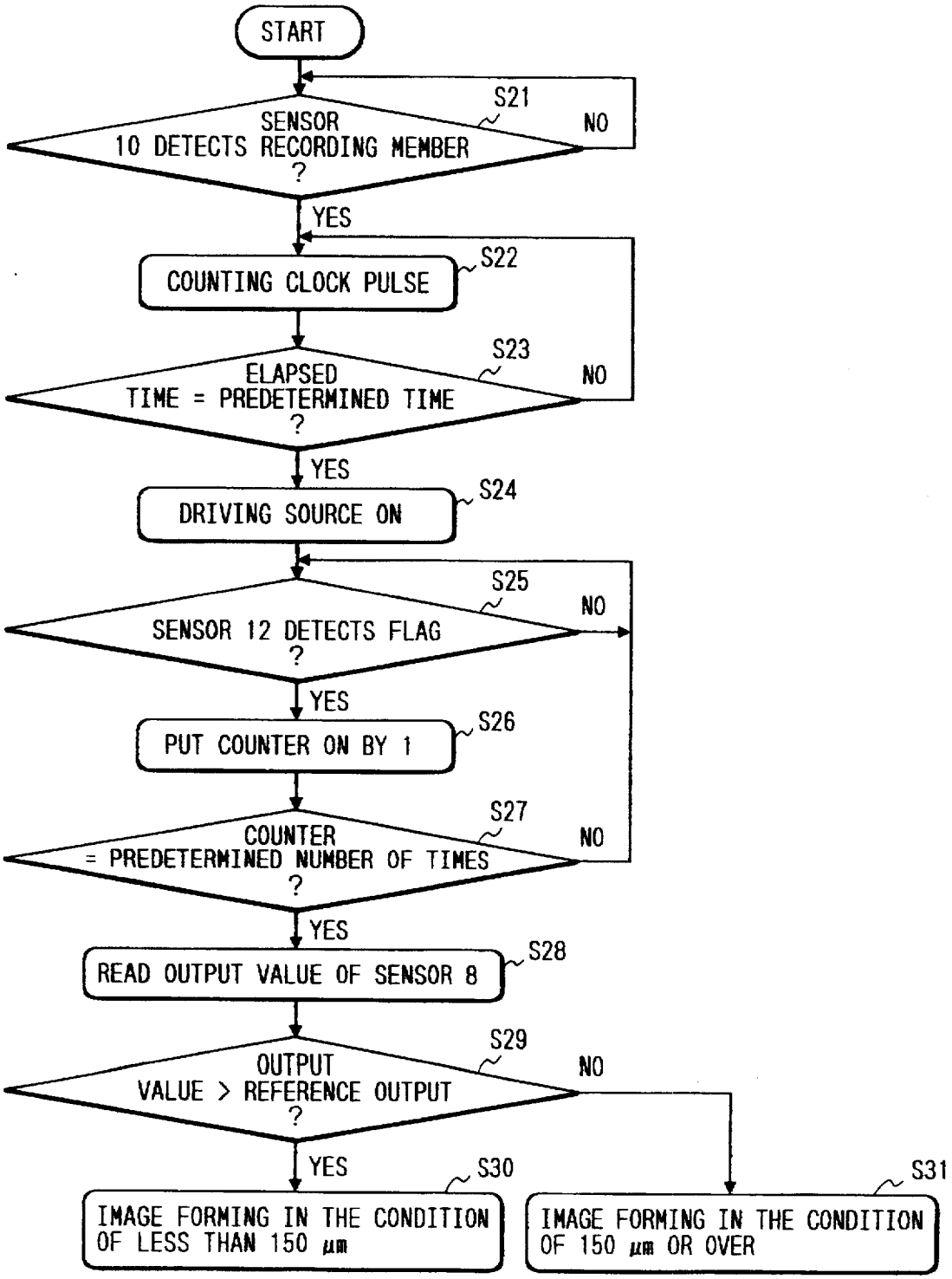
FIG. 4 is a flowchart for explaining a second control example in the embodiment of the first invention.

According to this control example, the method of detecting the thickness of the recording member P is the same as those of the above two examples, but the rollers 1, 2 are used also as means for determining the position of the recording member P in the feeding direction when carrying out image formation. The operation of this case is shown in a flowchart of FIG. 4.

The rollers 1, 2 are stopped until the recording member detecting sensor 10 on the upstream side of the rollers detects the recording member P. After the recording member P has reached the sensor 10 and then a predetermined period of time set beforehand in accordance with the distance between the sensor 10 and the rollers 1, 2 has elapsed, the rollers 1, 2 are driven by the driving source 5 at a peripheral speed equal to the feeding speed of the recording member P (S21 to S24). This predetermined period of time is set longer than the time necessary for the recording member P to advance from the position of the sensor 10 to a nip portion of the rollers 1, 2. For this reason, the rollers 1, 2 are not rotated at the moment when the recording member P has reached the rollers 1, 2. Since the recording member P is fed by a pair of drive rollers (not shown) provided further in the upstream, a loop is formed at the nip portion of the rollers 1, 2, so that the recording paper P being fed obliquely is corrected so as to be fed straightly. After the elapse of the predetermined period of time, the roller 1, 2 start rotating. Then, image formation is carried out based on this time as reference, so that an image is formed on a predetermined position of the feeding direction on the recording member P.

On the other hand, from the moment when the rollers 1, 2 are rotated, each time the flag 11 on the feed roller 1 interrupts the light from the roller rotation angle detecting sensor 12 on the supporting member 6, CPU 9 counts the number of times of the detections of the flag 11. When the number of times reaches a predetermined number of times stored in a memory, the output value of the roller axes distance detection sensor 8 is read and stored in the memory. Then, this stored output value is compared with the output value (reference output) of the sensor 8 obtained and stored beforehand when the recording member with the thickness of 150 μm is pinched by the rollers 1, 2. Thereby, the thickness of the recording member P is judged and image formation is carried out under a preferable condition (S25 to S31).

[First Embodiment of the Second Invention]

Figure 5:
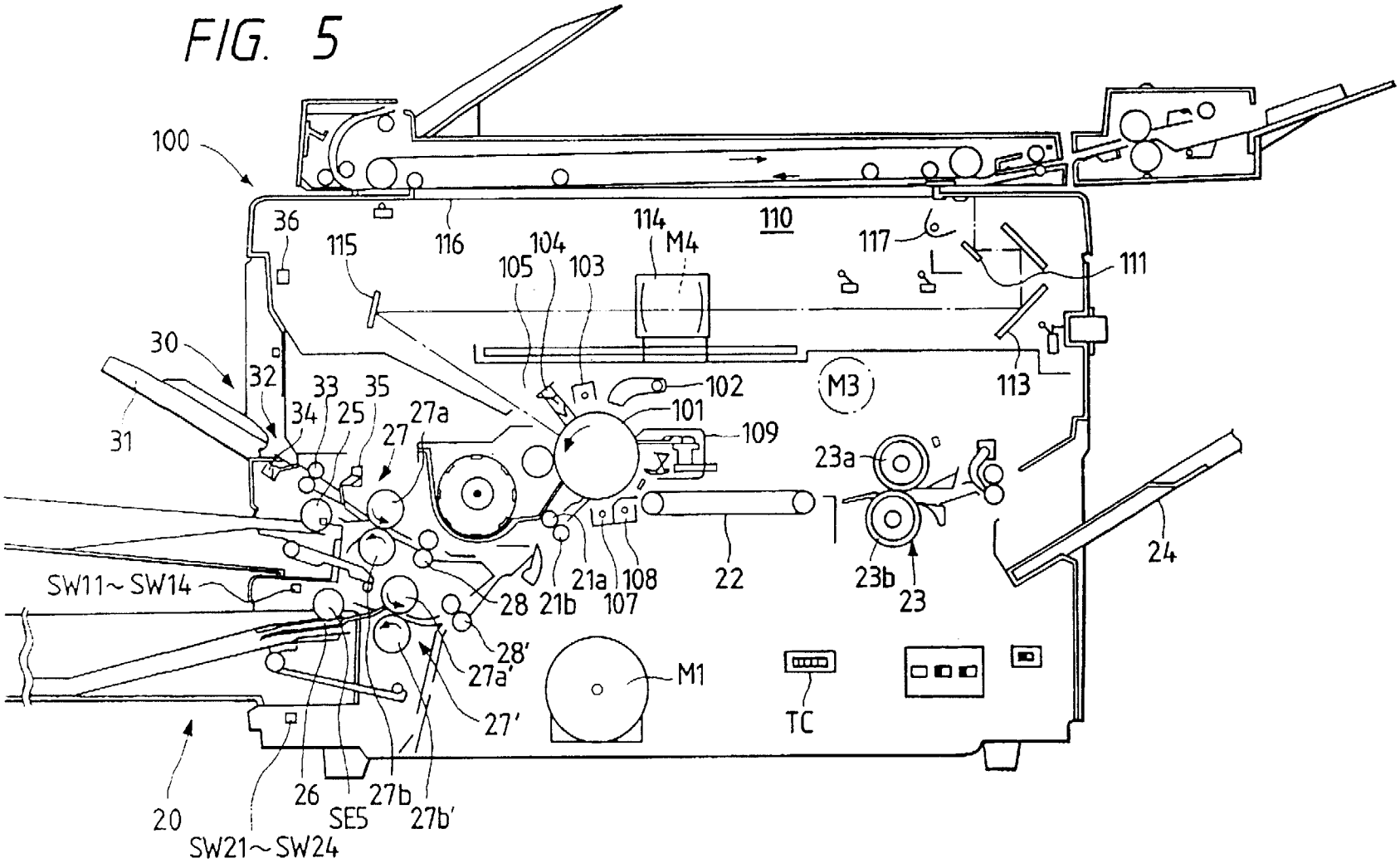
FIG. 5 is a schematic diagram showing a copying machine equipped with a sheet thickness detecting device according to an embodiment of the second invention.

FIG. 5 is a schematic diagram showing a copying machine equipped with a sheet thickness detecting device according to the second invention. First, the structure and the operation of the copying machine will be described.

A photosensitive drum 101 is supported in the substantially central part of a main body of the copying machine 100 so as to be rotatable in the counterclockwise direction. Around the photosensitive drum 101 are sequentially disposed an eraser lamp 102, an electrostatic charger 103, an eraser 104 for edge and intermediate of image, a developing unit 106, a transfer charger 107, a separation charger 108 and a cleaning unit 109. The surface of the photosensitive drum 101 is provided with a photoreceptor. When passed near the eraser lamp 102 and the electrostatic charger 103, this photoreceptor is uniformly charged. Then, when the exposure of an image is carried out via a slit portion 105 from a scanning optical system 110, a static latent image is formed on the surface of the photoreceptor. The eraser 104 has a plurality of light emitting diodes (LED) arranged in the width direction of the image and eliminates the unnecessary charge on the surface of the photosensitive drum 101 at the time of image formation. The structure and control thereof will be described later.

The optical system 110 is constituted of a light source 117, movable mirrors 111, 112, 113, a lens 114, and a mirror 115 so as to be able to scan the image of an original under a glass 116. The light source 117 and the movable mirror 111 are shifted together at a speed of v/m (m: copy magnification) in the leftward direction relative to the peripheral speed v of the photosensitive drum 101 (constant irrespective of copy magnification, and the movable mirrors 112 and 113 are shifted together at a speed of v/2 m in the leftward direction. In changing the copy magnification, the lens 114 is shifted on the optical axis and the mirror 115 is shifted and swung thereby to correct the light path. Because the principle of such a magnification changing mechanism is well known, the following description is limited to a point that the positions of the lens 114 and the mirror 115 are controlled interlockingly by a step motor M4 based on magnification data to be described later, and the detailed description of an interlocking mechanism is omitted. Also, for the same reason, the description for the control of the speed (v/m) of the scanning optical system 110 is limited to a point that it is performed by changing the rotation speed of a DC motor M3 based on the magnification data, and the detailed description of the control method is omitted.

An automatic paper feeding mechanism 20 having upper and lower cassette mounting sections is provided in the left side of the copying machine 100. A manual paper feeding mechanism 30 is provided above the mechanism 20. A recording member (copying paper) is fed in the copying machine 100 by the automatic paper feeding mechanism 20 or the manual paper feeding mechanism 30, stopped for a while by a pair of resist rollers 21*a*, 21*b* constituting the sheet thickness detecting device of the second invention, and sent to a transfer section in synchronism with an image to be formed on the photosensitive drum 101. Then, after a toner image is transferred to the recording member by the transfer charger 107, the recording member is separated from the surface of the photosensitive drum 101 by the separation charger 108, conveyed by a conveyor belt 22 to a fixing unit 23 to effect fixing of the image, thereafter ejected to a tray 24. At this time, a key counter KC operates with the timing of feeding the recording member and a total counter TC operates with the timing of ejecting the recording member. And, "1" for indicating a copying operation is added to the figure of each of the counters.

After the transferring operation, the toner and charge remaining on the surface of the photosensitive drum 101 are eliminated by the cleaning unit 109 and the eraser 102 in preparation for the following copying operation.

Either the automatic paper feeding mechanism 20 or the manual paper feeding mechanism 30 is selectively utilized. When a sheet table 31 is closed, an inlet 32 is covered. On the other hand, when the sheet table 31 is opened, the inlet 32 is opened to be seen from outside and the sheet table 31 becomes a guide for recording members to be set manually. When the sheet table 31 is in the open state and a paper insertion detecting sensor 34 detects the insertion of recording members, the copy mode becomes a manual paper feeding mode. On the other hand, when the sheet table 31 is closed, or the automatic paper feeding is selected, or a signal is output due to a ten key operation for setting the number of copies, the copy mode becomes an automatic paper feeding mode.

In the case of the automatic paper feeding, the image forming system including the photosensitive drum 101 starts operating by the operation of a print key (not shown) for starting a copying operation of the copying machine 100. Then, after the preparatory processing of the photosensitive drum 101 has been completed, a feed roller 25 or 26 is driven. Thereafter, the scanning optical system 110 is shifted owing to a scan start signal output in accordance with the feeding of a recording member, and the recording member is fed in synchronism with the image forming operation. Two or three recording members are pulled in the machine due to the rotation of the feed roller 25 or 26, but only the uppermost recording member is fed by a sorting mechanism 27 or 27'.

The sorting mechanism 27 has upper and-lower rollers 27*a* and 27*b* while the sorting mechanism 27' has upper and lower rollers 27'*a* and 27'*b*. The upper rollers 27*a*, 27'*a* are rotated in the recording member advancing direction while the lower rollers 27*b*, 27'*b* are rotated in the recording member returning direction. The second upper and lower recording members pulled in the copying machine by the feed roller together with the uppermost recording member are pushed back by the lower roller 27*b* or 27'*b* and only the uppermost recording member is fed toward an intermediate roller 28 or 28'. The intermediate rollers 28, 28*a* are driven in connection with the resist rollers 21*a*, 21*b*.

On the other hand, in the case of the manual paper feeding, when a recording member is inserted in the inlet 32 and its insertion is detected by the sensor 34, feed rollers 33 are rotated to pull the recording member in the machine. Simultaneously or slightly thereafter, the photosensitive drum 101 starts to be driven in the same manner as at the time of the above operation of the print key. Then, the recording member is once stopped at the position of a recording member detecting switch 35. After the preparatory processing (including the rotation) of the photosensitive drum 101 has been completed, the feed rollers 33 are again rotated to feed the recording member in the machine.

The sheet table 31 is removably mounted to the main body of the copying machine 100. Instead of the sheet table 31, it is possible to mount a general-purpose paper feeding unit containing feed rollers and a motor. Thereby, the copying machine can have the same function as a copying machine with three automatic paper feeding sections.

The respective cassette mounting sections of the automatic paper feeding mechanism 20 are provided with size detecting switches SW11 to SW14 and SW21 to SW24. The actuating condition of the switches is changed by the arrangement of projections or magnets (not shown) provided on a cassette mounted to the cassette mounting section, and the size of copying papers contained in the cassette is discriminated by a binary code of four bits. Various mechanisms for discriminating the size of recording members by the use of a cassette containing the recording members are well known so its detailed description is omitted.

Figure 6:
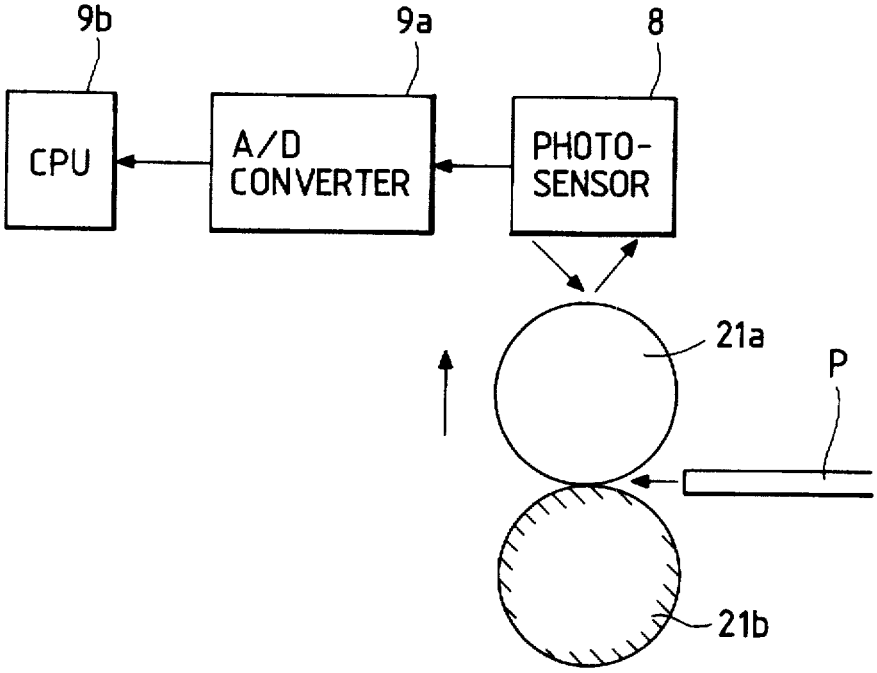
FIG. 6 is a block diagram showing the sheet thickness detecting device according to the embodiment of the second invention.

FIG. 6 is a schematic diagram showing the sheet thickness detecting device provided in the copying machine according to the second invention.

The sheet thickness detecting device is constructed of the resist rollers 21*a*, 21*b*, the reflection type photosensor 8 for roller pair axes distance detection, the A/D converter 9*a* and CPU 9*b*. The resist rollers 21*a*, 21*b* are formed of metal and rubber, respectively. Also, the sensor 8 is constituted of the light emitting element and the light receiving element. Infrared light emitted from the light emitting element of the sensor 8 is reflected by the metallic roller 21*a* and received by the light receiving element, and voltage proportional to the movement of the roller 21*a* is output.

In this sheet thickness detecting device, the movement of the metallic roller 21*a* is detected by the sensor 8 for roller pair axes distance detection, and the output value of the sensor 8 is converted into a digital signal by the A/D converter 9*a*. Then, the calculation is performed by CPU 9*b*, as described later.

Figure 7:
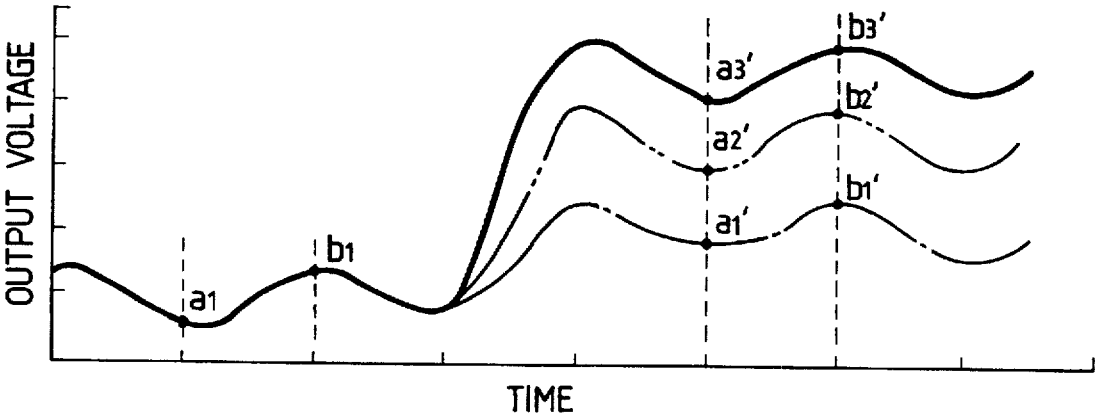
FIG. 7 is a graph showing output waveforms of a sensor when three types of recording members are detected in the embodiment of the second invention.

FIG. 7 is a graph showing output waveforms of the sensor when three types of A4-size recording members each having different sheet thickness are detected. Since the magnitude of the eccentricities of the resist rollers 21*a*, 21*b* is superposed on the waveform indicating the sheet thickness of the recording member in a rotation cycle of the roller, the sheet thickness of the recording member cannot be identified accurately according to the conventional method in which the value of the threshold voltage is determined. Then, the value of a point on the waveform and the value of a point on the waveform advanced half a roller rotation cycle away from the initial point are averaged. In the case of FIG. 7, before and while the recording members pass between the rollers, the following values are obtained:

$$V_0=(a_1+b_1)/2$$

$$V_1=(a'_1+b'_1)/2$$

$$V_2=(a'_2+b'_2)/2$$

$$V_3=(a'_3+b'_3)/2$$

This calculation is performed by CPU 9*b* by the use of the value converted by the A/D converter 9*a*.

Thus, by averaging the output values of the two points on the waveform spaced half a roller rotation cycle away from each other, the influence of the eccentricities of the rollers 21*a*, 21*b* can be eliminated. Therefore, when the difference (e.g., $V_1-V_0$) between the output value $V_0$ obtained before the recording member passes between the rollers 21*a*, 21*b* and the output value $V_1$, $V_2$ or $V_3$ obtained while the recording member is passing between the rollers 21*a*, 21*b* is calculated by CPU 9*b*, the thickness of the recording member can be obtained accurately without being affected by the eccentricities of the rollers 21*a*, 21*b*.

[Second Embodiment of the Second Invention]

Figure 8:
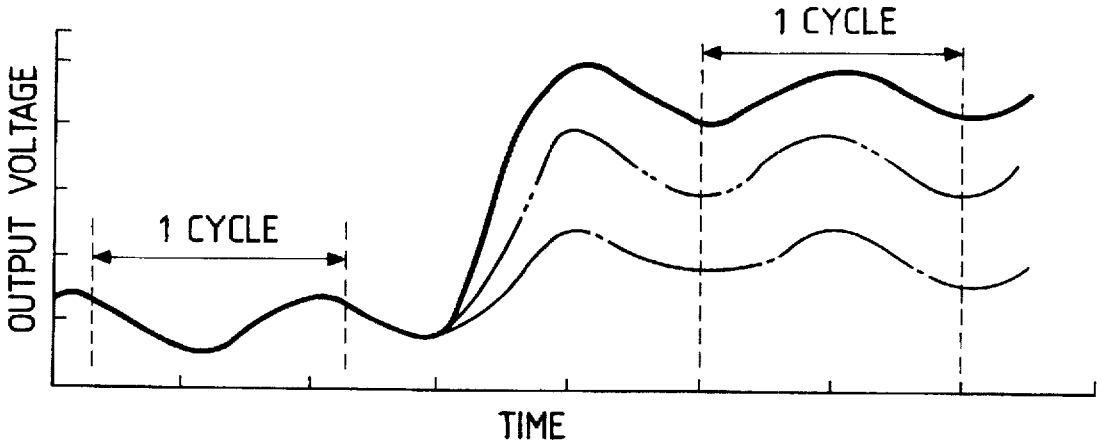
FIG. 8 is a graph showing output waveforms of a sensor in a second embodiment of the second invention.

Although data of the only two points on the output waveform of the roller axes distance detection sensor 8 are used in the above first embodiment, data of the output waveform for a roller rotation cycle-are sampled and averaged in this embodiment, as shown in FIG. 8. The calculation process is different, but the structure of the sheet thickness detecting device is the same as that in the first embodiment. According to this calculation method, the accuracy can be further enhanced.

[Third Embodiment of the Second Invention]

Figure 9:
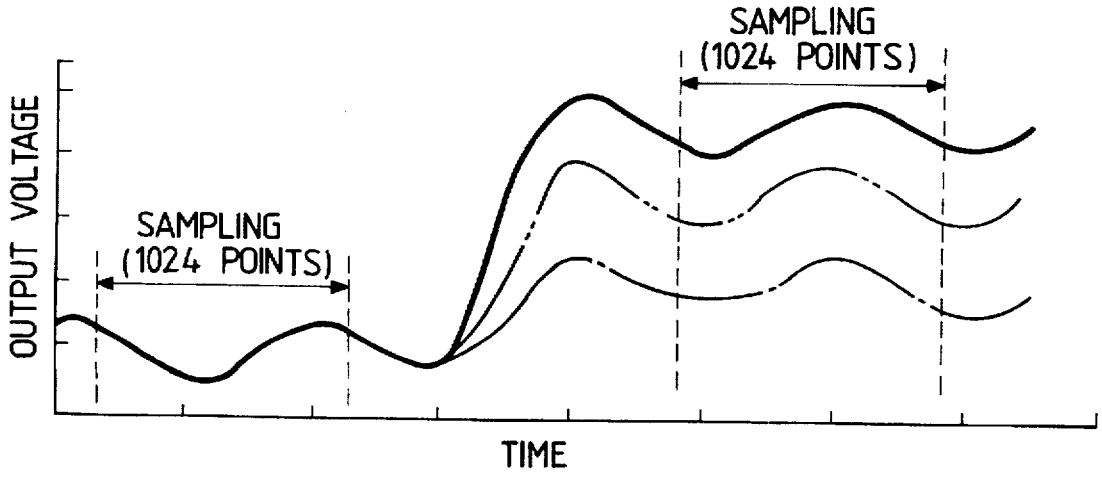
FIG. 9 is a graph showing output waveforms of a sensor in a third embodiment of the second invention.
Figure 10:
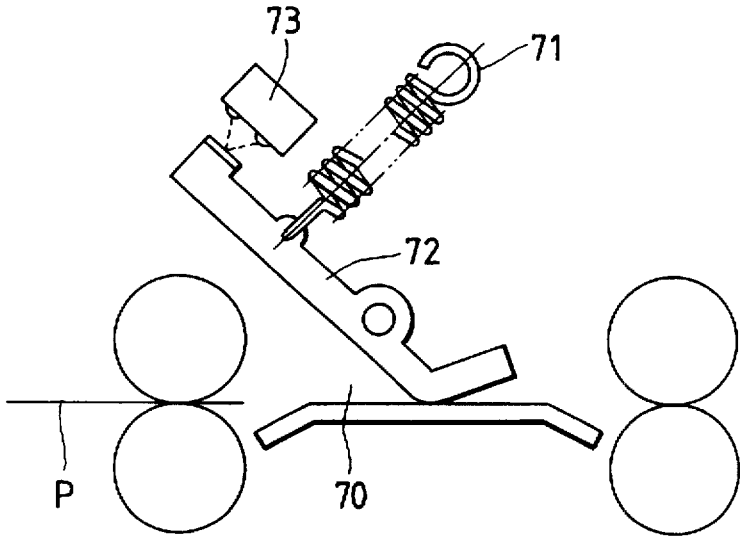
FIG. 10 PRIOR ART
FIG. 10 is a schematic diagram showing a conventional sheet thickness detecting device using an actuator.
Figure 11:
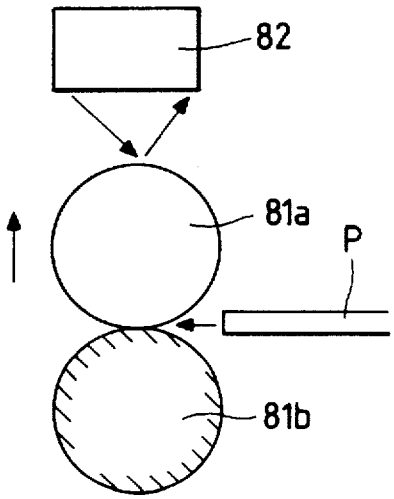
FIG. 11 PRIOR ART
FIG. 11 is a schematic diagram showing a conventional sheet thickness detecting device using a pair of rollers.
Figure 12:
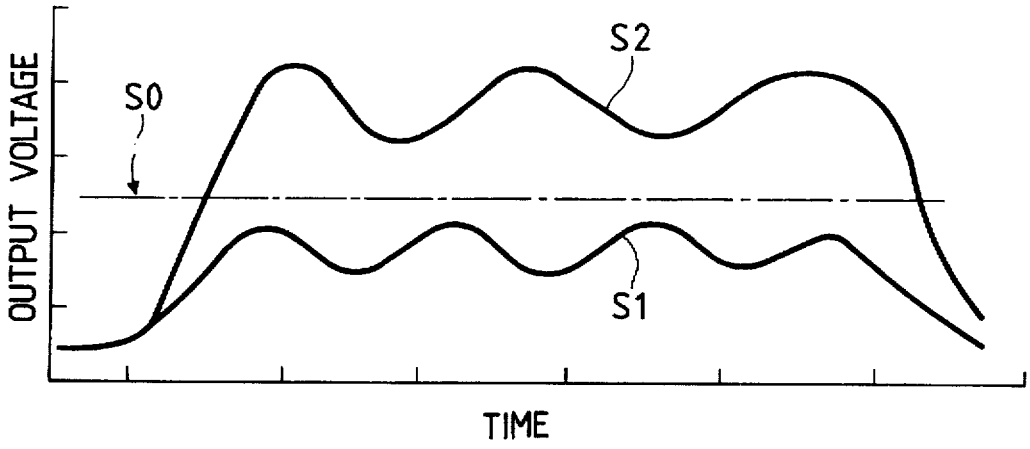
FIG. 12 PRIOR ART
FIG. 12 is a graph showing output waveforms of a sensor when an ordinary sheet and a slightly thicker sheet are detected in the conventional sheet detecting device by the use of the pair of rollers.
Figure 13:
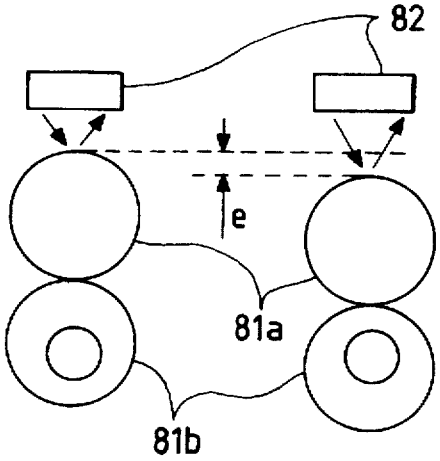
FIG. 13 PRIOR ART
FIG. 13 is a diagram for explaining a problem in the conventional sheet thickness detecting device by the use of the pair of rollers.

In the third embodiment, as shown in an output waveform graph in FIG. 9, of the waveform of the sensor 8, in a region where the recording member has not passed between the rollers 21*a*, 21*b* yet and a region where the recording member is passing the rollers 21*a*, 21*b*, data (e.g., 1024 points) capable of fast Fourier calculation are collected and the output voltage is expanded in Fourier series. That is, the following equation is obtained:

$$V = X_0 + X_1 \sin wt + X_2 \sin(2wt) + \ldots + Y_1 \cos wt + Y_2 \cos(2wt) + \ldots$$

Then, the sheet thickness of the recording member is obtained by subtracting the direct current component $X_0$ during the passage of the recording member between the rollers from the direct current component $X_0'$ before the passage of the recording member between the rollers.

When the roundness of the rollers 21*a*, 21*b* is poor and the degree of the eccentricities of the rollers is large, the deviation from the circular form and the eccentricities are superposed on the waveform indicating the sheet thickness of the recording member. However, according to this calculation, the sheet thickness of the recording member can be obtained with high precision without being affected by such factors. The calculation process in CPU 9*b* is different, but the structure of the sheet thickness detecting device is the same as those in the above first and second embodiments.

[First Embodiment of the Third Invention]

Figure 14:
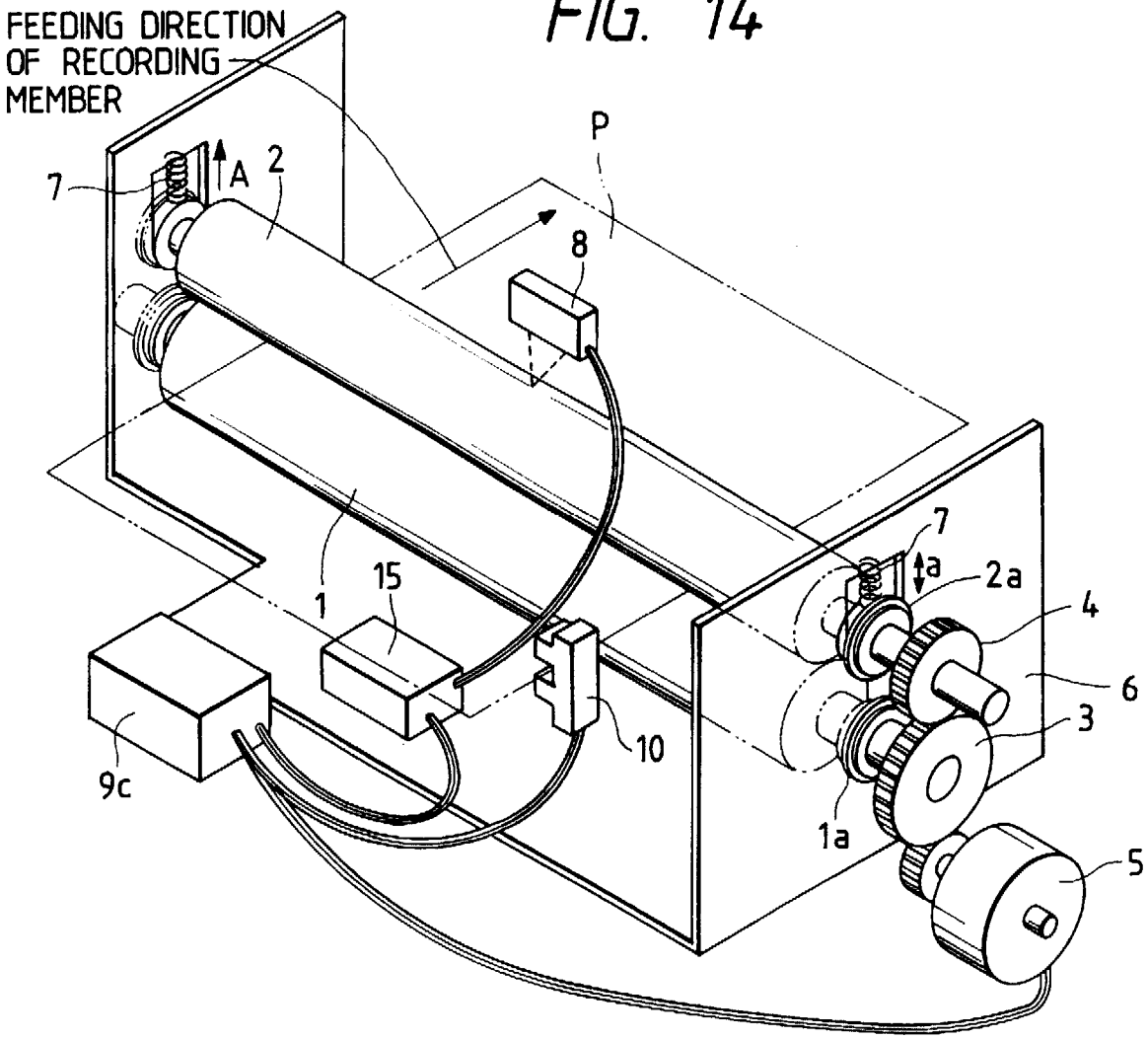
FIG. 14 is a perspective view showing a sheet thickness detecting device according to a first embodiment of the third invention.
Figure 15:
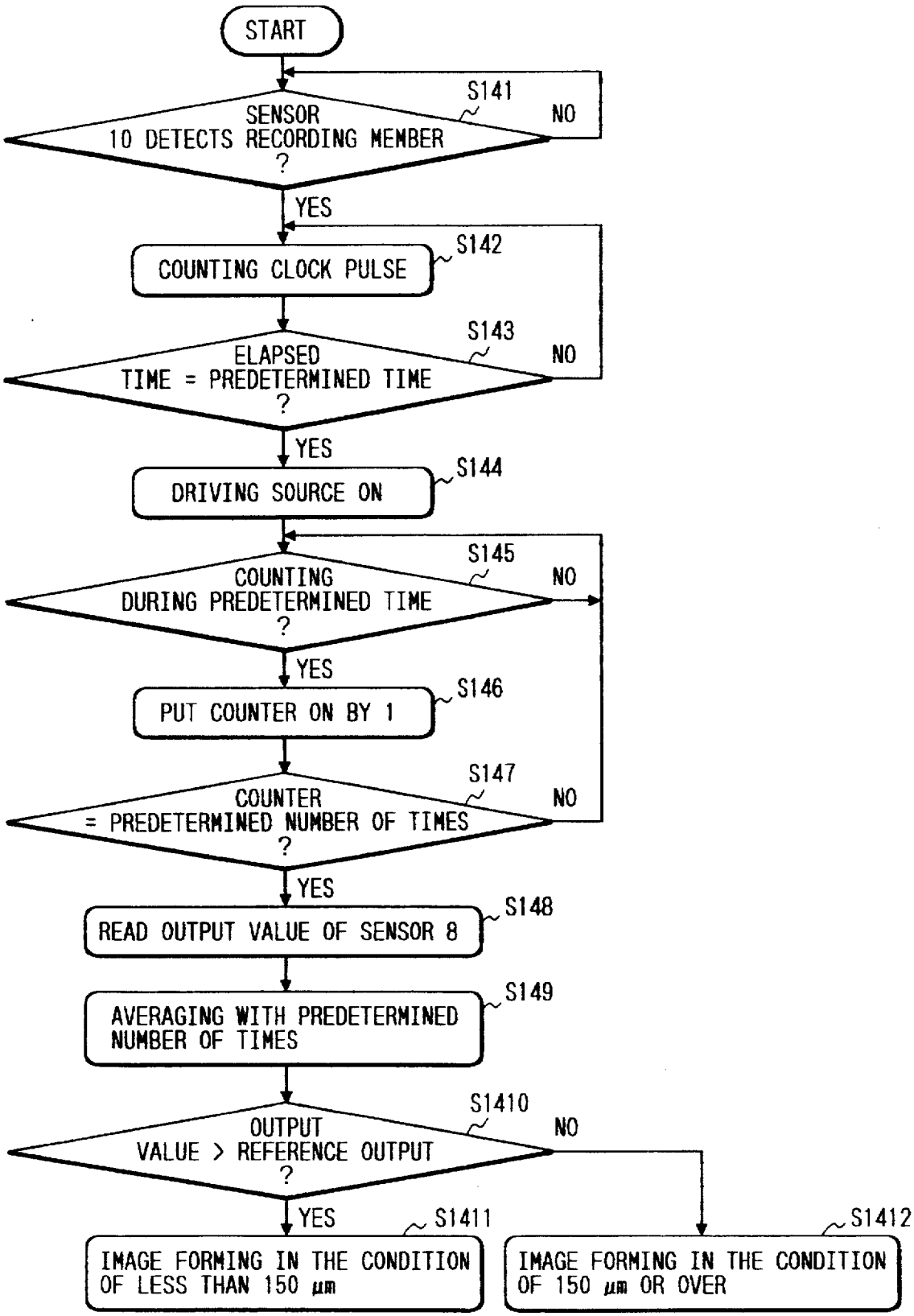
FIG. 15 is a flowchart showing the operation of the sheet thickness detecting device of the first embodiment of the third invention.

FIG. 14 is a perspective view showing a sheet thickness detecting device according to the first embodiment of the third invention for detecting the thickness of a recording member. FIG. 15 is a flowchart showing the operation of the sheet thickness detecting device.

In FIG. 14, the feed roller 1 and the pressure roller 2 are for pinching and feeding a recording member. The transmission type photosensor 10 is disposed on the upstream side of the rollers 1, 2 in the feeding direction of the recording member to detect the leading end of the recording member when its light path is interrupted by the leading end of the recording member. The gears 3, 4 are mounted on shaft end portions of the rollers 1, 2 to rotate together with the rollers, respectively. The respective pitch diameters of the gears are approximately equivalent to the respective outer diameters of the rollers 1, 2, thus the gears 3, 4 are meshed with each other and the phase relationship between the rollers 1 and 2 in the direction of rotation is always constant. This advantage that the phase relationship becomes constant is relevant to the operation of detecting the thickness of the recording member, and will be described later. A drive source 5 such as a motor is connected to the gear 3 to drive the rollers 1, 2. The rollers 1, 2 are supported via respective bearings 1*a*, 2*a* by the supporting member 6. Particularly, the pressure roller 2 is supported so as to be shiftable only in a direction a as indicated by an arrow in the drawing and its both end portions are urged by the springs 7 toward the feed roller 1. The rollers 1, 2 are formed of metal so as to prevent their deformation. Also, when the recording member is pinched by the rollers, the eccentricities of the rollers cause an error at the time of measurement, thus, it is necessary to form the rollers with high precision. For example, if the center of each of the rollers is off-centered by 20 μm, the distance between the axes of the rollers is changed maximumly by ±40 μm due to their phases. Therefore, it becomes difficult to discriminate even the recording member having a thickness of 100 μm from that of 200 μm.

The reflection type photosensor 8 is mounted on the supporting member 6. For detection, infrared light is emitted from the light emitting element of the sensor 8 to the pressure roller 2. The infrared light reflected by the surface of the pressure roller 2 is received by the light receiving element of the sensor 8. The sensor 8 outputs voltage corresponding to the amount of reflected light. In this case, the output voltage approximately proportional to the distance between the rollers is obtained. When measuring the displacement of such a cylindrical roller, the mounting error of the sensor affects the measured value. However, it is not preferable to enlarge the diameter of the roller so as to reduce the curvature of the roller, since the device becomes large. Then, when the sensor has the light emitting element and the light receiving element, both elements are disposed in the axial direction of the roller. The output from the sensor is converted into a digital signal by an A/D converter 15 and sent to a CPU 9*c*.

The operation of detecting the thickness of the recording member by means of the device of this embodiment will be described with reference to a flowchart in FIG. 15.

In the present device, it is necessary to switch an image forming process between the recording member with the thickness of 150 μm or more and the recording member with the thickness of less than 150 μm. In this device, the output value of the photosensor 8 obtained when no recording member is nipped by the rollers 1, 2 is stored in a memory in advance.

Figure 16:
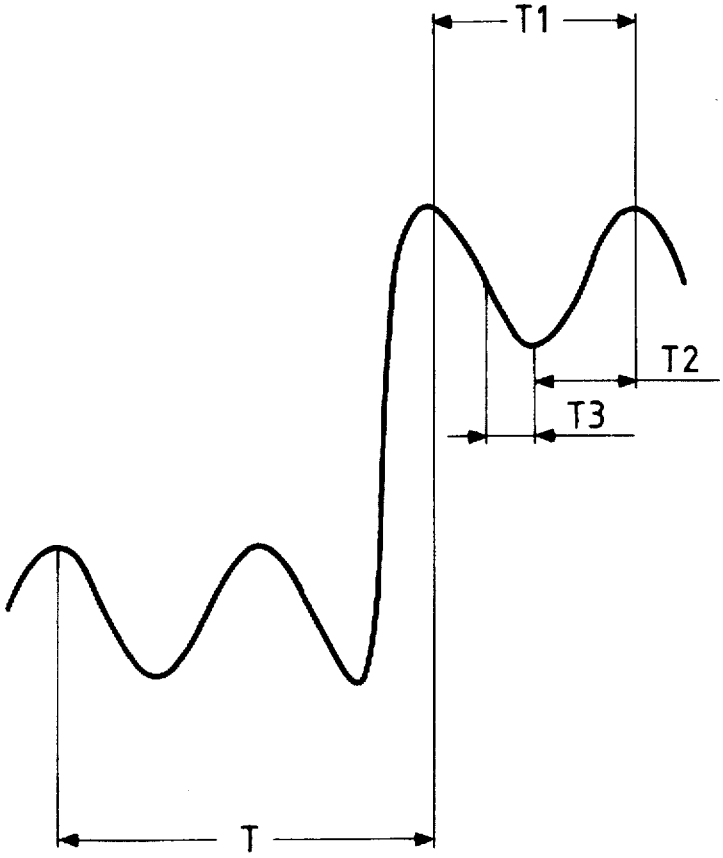
FIG. 16 is a graph showing an output waveform of the sensor of the first embodiment of the third invention.

When the leading end of a recording member 13 being fed from the upstream shields light emitted from the photosensor 10, the output of the photosensor 10 is changed to detect the reaching of the leading end (S141). When the leading end of the recording member 13 is detected, the counting of a clock pulse (S142) is started to monitor whether a predetermined period of time has elapsed. As soon as it is judged that the predetermined period of time has elapsed (S143), CPU 9*c* drives the driving source 5 to cause the rollers 1, 2 to be rotated at a peripheral speed equal to the feeding speed of the recording member 13 (S144). Thereafter, the leading end of the recording member 13 reaches the rollers 1, 2, and is pinched and fed by the rollers 1, 2. When the recording member 13 is pinched by the rollers 1, 2, the distance between the axes of the rollers 1, 2 is increased by an amount corresponding to the thickness of the recording member 13. Also, the distance is changed momently in accordance with the rotation of the rollers due to the eccentricities of the rollers. However, as the respective gears 3, 4 of the feed and pressure rollers 1, 2 are meshed with each other, a periodic waveform is output from the sensor 10, as shown in FIG. 16.

Therefore, even though the eccentricity of each roller is 10 μm, if data is picked up for each increase of a rotation cycle T1 of the roller, a half of the rotation cycle T2 or a quarter of the rotation cycle T3, it is possible to calculate output values of the sensor without being affected by the eccentricities of the rollers by carrying out the following averaging process.

From the moment when the recording member 13 reaches the sensor 10 disposed on the upstream side of the rollers 1, 2, the rollers 1, 2 start rotating. After a predetermined period of time (T) necessary for the recording member 13 to be pinched by the rollers 1, 2 has elapsed after the start of rotation of the rollers, data is stored in a memory for each increase of Ti, T2, or T3 (S148). When the number of points where data are picked up reaches a predetermined number stored beforehand in the memory, all the data are added and divided by the predetermined number to obtain an average value (S149), which then is stored in the memory. Then, a value (a value obtained before the recording member is pinched by the rollers) stored beforehand in the memory is subtracted from the obtained average value. Thereafter, the thickness of the recording member is judged by comparing the resultant value with a voltage value obtained and stored beforehand in the memory when a recording member with the thickness of 150 μm is nipped by the rollers 1, 2 (S1410).

[Second Embodiment of the Third Invention]

In order to detect the sheet thickness of the recording member, a pair of metallic rollers are used in the above embodiments. However, when these metallic rollers are contained in an image forming apparatus, the apparatus becomes large. As its countermeasures, it is considered to change the structure of the rollers so as to detect the sheet thickness.

Figure 17:
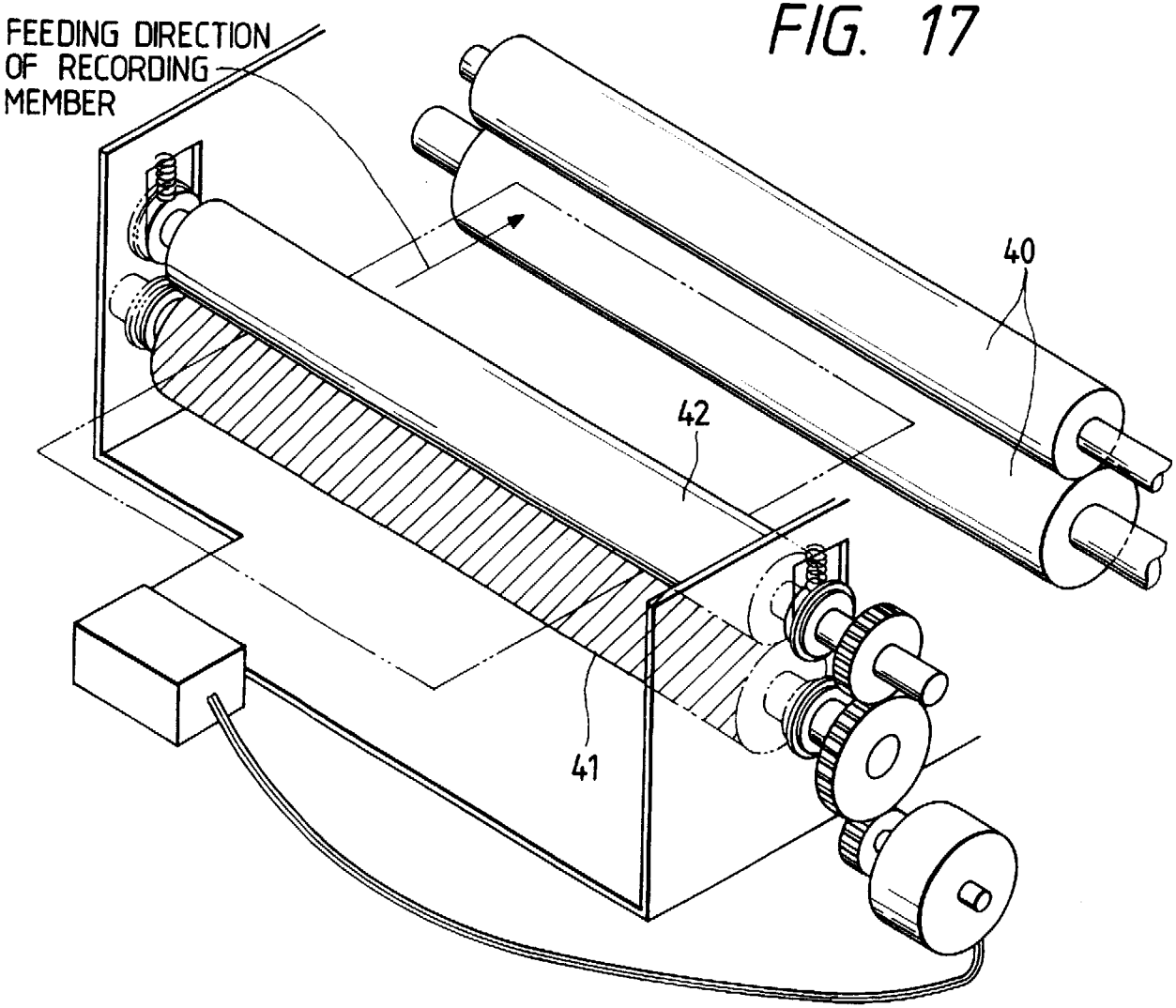
FIG. 17 is a perspective view for explaining the structure of conventional rollers.

In order to feed sheets such as papers having various thicknesses in the image forming apparatus, a pair of drawing rollers are disposed in front of resist rollers 40 as shown in FIG. 17. The drawing rollers consist of a feed roller 41 and a pressure roller 42. Generally, the feed roller 41 is an elastic body while the pressure roller 42 is a rigid body. According to this structure, the pressure roller 42 is liable to be deformed. In that case, the sheet thickness cannot be detected accurately.

Figure 18:
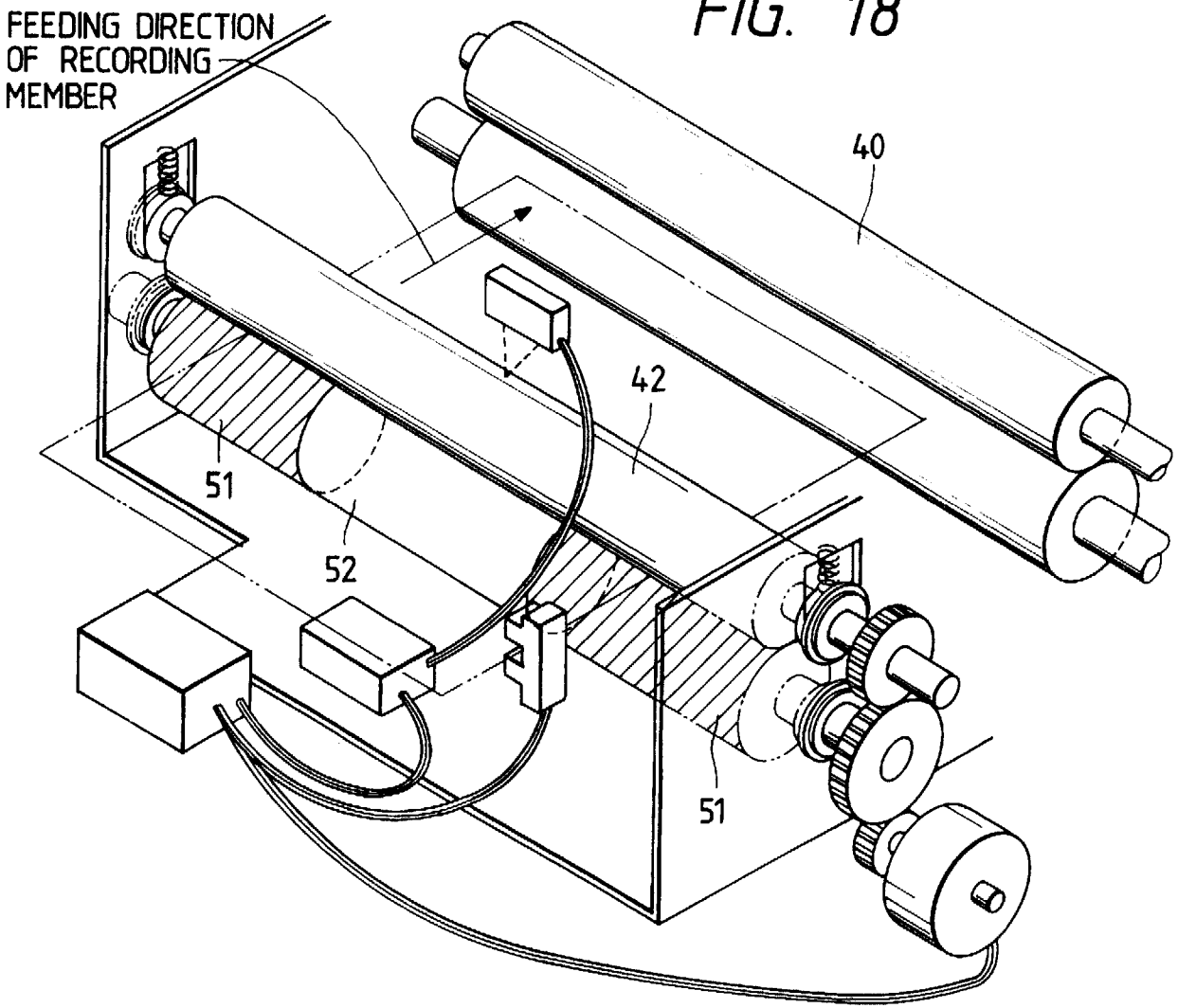
FIG. 18 is a perspective view showing a sheet thickness detecting device according to a second embodiment of the third invention.

Then, as shown in FIG. 18, a feed roller is compositively formed of an elastic body and a rigid body. Namely, the ordinary feed roller of FIG. 17 is divided into three portions. The lateral side portions 51 are formed of an elastic body while an intermediate portion 52 is formed of a rigid body.

The diameter of the elastic portions 51 is made slightly larger than that of the rigid portion 52. The elastic portions are deformable. The rigid portion 52 imparts a feeding-force to a recording member together with the pressure roller 42 and is shifted by an amount corresponding to the thickness of the recording member.

Figure 19:
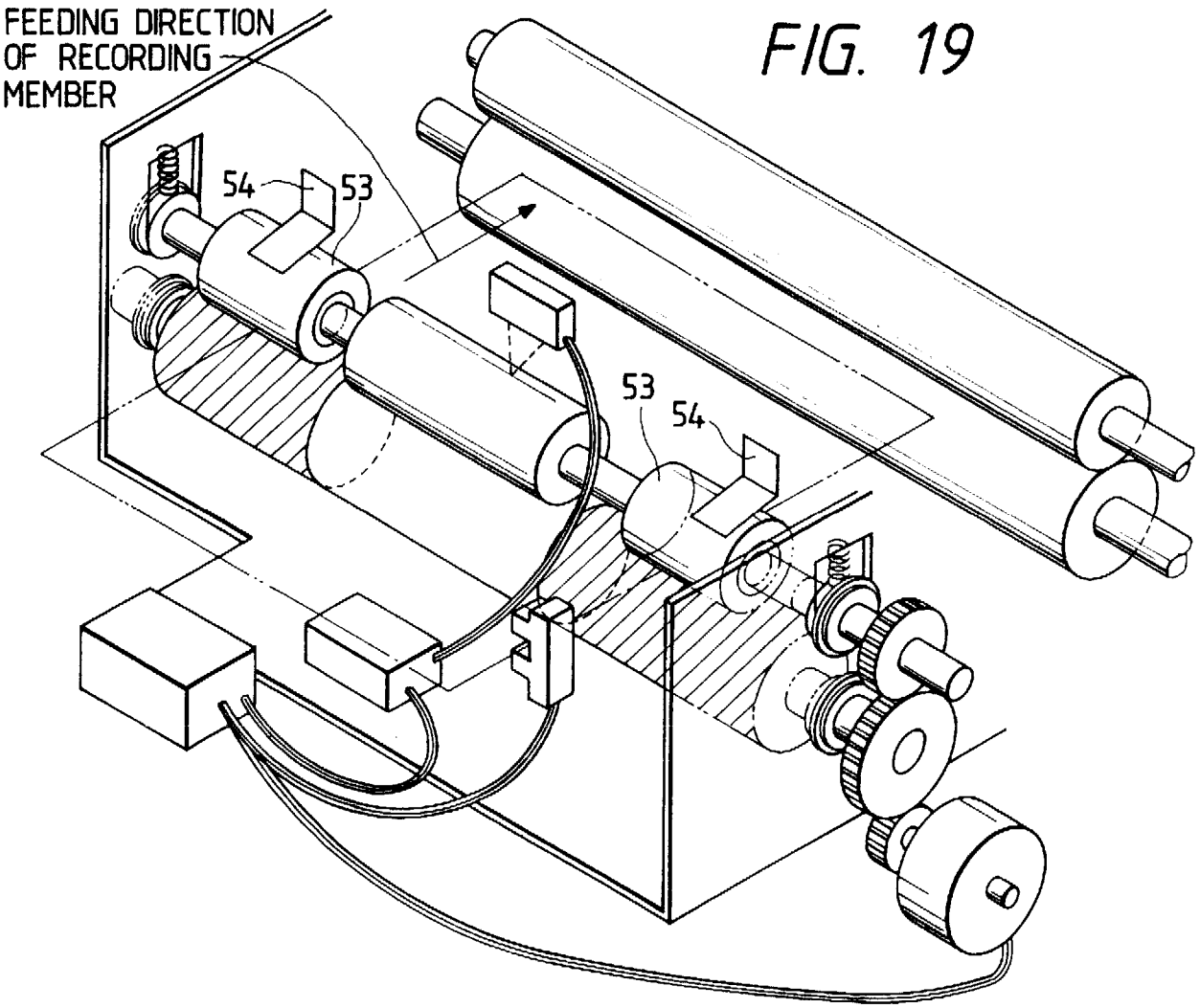
FIG. 19 is a perspective view showing a sheet thickness detecting device according to the second embodiment of the third invention.

FIG. 19 shows an example in which a driven roller is used. The driven rollers 53 is made of POM (polyoxymetylene) having good sliding ability. The driven rollers 53 are urged by pressure springs 54. According to this structure, the recording member can be fed more smoothly.

[Third Embodiment of the Third Invention]

Although the reflection type photosensor is used in the above-described embodiments, a gap sensor, a PSD (Position Sensitive Detector) or the like may be used. In this embodiment, irregularly reflected light is used.

When the surface of a roller is polished, a sensor cannot exhibit its true performance due to regularly reflected light. Therefore, in this embodiment, sandblasted rollers are used. In consideration of durability, the surface is treated with abrasive grain 300.

According to the sheet thickness detecting device of the first invention, it is possible to detect the thickness of a recording member accurately without being affected by eccentricities of the rollers. That is, it is possible to detect it irrespective of the accuracy of the parts. As a result, various sheet thicknesses of recording member can be identified precisely, and the image forming apparatus can be controlled in accordance with the sheet thickness.

Also, it is possible to cope with various thicknesses of recording member without being affected by the amount of curl and without staining the recording surface of the recording member.

Particularly, when a pair of rollers are connected to each other with the gears having the pitch diameters equal to the respective outer diameters of the rollers, the detection accuracy will never depend on the eccentricities of the rollers. Therefore, there is no need to process the parts with high precision and it is possible to provide an inexpensive sheet thickness detecting device.

Further, by providing a pair of rollers for detecting the thickness of a recording member and means for detecting the reaching of the recording member to the rollers, the detection of the distance between the axes of the rollers will not be affected by disturbance such as a shock occurring when the recording member is pinched by the rollers, so that the thickness of the recording member can be detected accurately.

Also, in the sheet thickness detecting device of the second invention, it is possible to detect the thickness of a recording member accurately without being affected by eccentricities of the rollers. That is, it is possible to detect it irrespective of the accuracy of the parts. As a result, various sheet thicknesses can be identified surely and the image forming apparatus can be controlled in accordance with the sheet thickness.

In the sheet thickness detecting device of the third invention, it is possible to detect the thickness of a recording member with high precision irrespective of the accuracy of the parts. Also, various sheet thicknesses of recording members can be detected without being affected by the amount of curl and without staining the recording surface of recording member.

When a pair of rollers are connected to each other with the gears having the pitch diameters equal to the respective outer diameters of the rollers, the detection accuracy will not depend on the eccentricities of the rollers completely. Therefore, there is no need to process the parts with high precision and it is possible to provide an inexpensive sheet thickness detecting device.

Further, there is a case that the distance between the rollers is affected by disturbance such as a shock occurring when the recording member is pinched by the rollers, but it is possible to detect the sheet thickness of the recording without being affected by such disturbance by providing a pair of rollers for detecting the sheet thickness of the recording member and means for detecting the reaching of the recording member to the rollers.

What is claimed is:

1. A sheet thickness detecting device for detecting the thickness of sheets by detecting a change in distance between respective axes of a pair of rollers for pinching and feeding the sheets, said sheet thickness detecting device comprising:

a pair of rollers for pinching and feeding a sheet:

distance detecting means for detecting a distance between said pair of rollers;

angle detecting means for detecting a state that one of said rollers is positioned only at a single predetermined angle of rotation: and judging means for judging the thickness of the sheet in accordance with a signal supplied from said distance detecting means when the sheet is not pinched by said pair of rollers in a position of the predetermined angle of rotation detected by said angle detecting means and a signal supplied from said distance detecting means when the sheet is pinched by said pair of rollers in the position of the predetermined angle of rotation.

2. A sheet thickness detecting device according to claim 1, further comprising a pair of gears connected to said pair of rollers respectively for rotating together with said rollers.

3. A sheet thickness detecting device according to claim 1 or 2, further comprising sheet detecting means for detecting side of said rollers in a feeding direction of said sheet.

4. A sheet thickness detecting device according to claim 3, wherein after the reaching of said sheet is detected by said sheet detecting means, and when the state that said one of said rollers is positioned at the predetermined angle of rotation is detected a predetermined number of times by said angle detecting means, the thickness of said sheet is judged by said judging means.

5. A sheet thickness detecting device according to claim 3, wherein after the reaching of said sheet is detected by said sheet detecting means, then after a predetermined period of time has elapsed, and when the state that said one of said rollers is positioned at the predetermined angle of rotation is detected by said angle detecting means, the thickness of said sheet is judged by said judging means.

6. A sheet thickness detecting device according to claim 3, wherein said rollers are in a stopped condition when said sheet reaches said rollers, and after a predetermined period of time has elapsed, said rollers.

7. A sheet thickness detecting device according to claim 1, wherein said rollers are driven by a driving source.

8. A sheet thickness detecting device according to claim 1, wherein said distance detecting means includes a photosensor having a light emitting element for emitting light to one of said rollers and a photoelectric conversion element for receiving said light emitted from said light emitting element and reflected from said one of said rollers and generating an electric signal.

9. A sheet thickness detecting device according to claim 8, wherein an outer surface of one of said rollers to which the light is emitted, is subjected to a blast treatment or is formed of a material having white color.

10. A sheet thickness detecting device according to claim 8, wherein the light emitting element and the photoelectric conversion element are disposed in an axial direction of said rollers.

11. An image forming apparatus for forming an image on a sheet, said image forming apparatus comprising:

image forming means and;

a thickness detecting device for detecting the thickness of the sheet to be fed to said image forming means by detecting a change in distance between respective axes of a pair of rollers for pinching and feeding the sheet, said sheet thickness detecting device including:

a pair of rollers for pinching and feeding the sheet;

distance detecting means for detecting the distance between said pair of rollers;

angle detecting means for detecting a state that one of said rollers is positioned only at a single predetermined angle of rotation; and judging means for judging the thickness of the sheet in accordance with a signal supplied from said distance detecting means when the sheet is not pinched by said pair of rollers in a position of the predetermined angle of rotation detected by said angle detecting means and a signal supplied from said distance detecting means when the sheet is pinched by said pair of rollers in the position of the predetermined angle of rotation.

12. A sheet thickness detecting device for detecting the thickness of a sheet, said sheet thickness detecting device comprising:

a roller supported so as to be movable in the sheet thickness direction;

first detecting means for detecting an amount of movement of said roller as it is abutted by the sheet conveyed from an upstream side in a sheet convey direction;

second detecting means for detecting a state that said roller is positioned at a single predetermined angle of rotation; and judging means for judging the thickness of the sheet in accordance with a signal supplied from said first detecting means when the sheet doesn't abut said roller in a position of the predetermined angle of rotation detected by said second detecting means and a signal supplied from said first detecting means when the sheet abuts said roller in the position of the predetermined angle of rotation.

13. A sheet thickness detecting device according to claim 12, wherein said roller rotates by a motor and feeds the sheet to a downstream side in the sheet convey direction.

14. A sheet thickness detecting device according to claim 12, wherein said first detecting means comprises a photosensor having a light emitting element for emitting light to said roller and a photoelectric conversion element for receiving said light emitted from said light emitting element and reflected from said roller.

15. An image forming apparatus for forming an image on a sheet, said image forming apparatus comprising:

image forming means;

a roller supported so as to be movable in the sheet thickness direction;

first detecting means for detecting an amount of movement of said roller as it is abutted by the sheet conveyed from and upstream side in a sheet convey direction;

second detecting means for detecting a state that said roller is positioned at a single predetermined angle of rotation;

judging means for judging the thickness of the sheet in accordance with a signal supplied from said first detecting means when the sheet doesn't abut said roller in a position of the predetermined angle of rotation detected by said second detecting means and a signal supplied from said first detecting means when the sheet abuts said roller in the position of the predetermined angle of rotation; and control means for controlling said image forming means in accordance with the judgement of said judging means.

* * * * *

UNITED STATES PATENT AND TRADEMARK OFFICE

CERTIFICATE OF CORRECTION

PATENT NO. : 5,743,521
DATED : April 28, 1998
INVENTOR(S) : Atsushi MUNAKATA, et al.

It is certified that error appears in the above-identified patent and that said Letters Patent is hereby corrected as shown below:

Column 1, line 6, delete "-in-part,".

Column 2, line 41, delete ". Therefore" and insert therefor --, therefore--;
Line 46, delete "mumly" and insert therefor --mally--.

Column 5, lines 24 and 66, after "upstream", both occurrences, insert --direction--.

Column 6, line 38, after "upstream", insert --direction--.

Column 8, line 36, delete "28*a*" and insert therefor --28′--.

Column 10, line 53, delete "its both" and insert therefor --both of its--;
Line 61, delete "maximully" and insert therefor --maximally--.

Column 11, line 26, after "upstream", insert --direction--;
Line 60, delete "Ti" and insert therefor --T1--.

Column 13, line 32, after "recording", insert --member--.

Signed and Sealed this

Twentieth Day of October, 1998

*Attest:*

*Attesting Officer*

BRUCE LEHMAN

*Commissioner of Patents and Trademarks*